US005605495A

United States Patent [19]

Jenkins, Jr.

[11] Patent Number: 5,605,495

[45] Date of Patent: Feb. 25, 1997

[54] KNIFE WITH SHARPENING MEMBER HANDLES

[76] Inventor: R. B. Jenkins, Jr., P.O. Box 2089, Gastonia, N.C. 28053-2089

[21] Appl. No.: 565,228

[22] Filed: Nov. 30, 1995

[51] Int. Cl.[6] ..... B24B 3/60; B26B 11/00

[52] U.S. Cl. ..... 451/45; 7/120; 30/138; 76/82

[58] Field of Search ..... 30/138, 139, 35; 7/120; 76/82; 451/45, 344

[56] References Cited

U.S. PATENT DOCUMENTS

| | | | |
|---|---|---|---|
| 407,055 | 7/1889 | Brede | 30/138 X |
| 848,251 | 3/1907 | Killian . | |
| 916,630 | 3/1909 | Timmons | 30/138 |
| 927,532 | 7/1909 | Heissenberger . | |
| 1,299,173 | 4/1919 | Grey | 30/138 X |
| 1,359,448 | 11/1920 | Stodder | 30/138 |
| 1,627,689 | 5/1927 | Culver | 30/138 X |
| 2,270,074 | 1/1942 | Miller . | |

FOREIGN PATENT DOCUMENTS

| | | |
|---|---|---|
| 5785 | 6/1905 | United Kingdom . |

*Primary Examiner*—Douglas D. Watts

*Attorney, Agent, or Firm*—Leatherwood Walker Todd & Mann

[57] ABSTRACT

A knife having removable handle members, wherein each handle member includes a sharpening member. Each sharpening member is carried adjacent the blade of the knife when the handles are attached. Upon removal of the handles, the sharpening members are carried by the handle members and are used in sharpening of the blade.

11 Claims, 2 Drawing Sheets

KNIFE WITH SHARPENING MEMBER HANDLES

BACKGROUND OF THE INVENTION

This invention relates generally to a sheath knife having detachable sharpening member handles for use in sharpening the blade of the knife.

The edge of a knife blade must be sharp in order to optimize its cutting performance. Accordingly, during manufacture, knife blades typically have their edges ground to a sharp cutting edge. Abrasive sharpening stones or belts would generally be used to perform this sharpening process so that when the knife is purchased by the user, the user receives a knife with a sharp cutting edge.

However, as the blade edge is used for cutting, the edge repeatedly encounters abrasive surfaces in the materials being cut, which, in time, dulls the edge of the blade, thereby reducing the blade's effectiveness. This requires the user to again sharpen the blade to restore the original edge.

Since sharpening can be a time-consuming, tedious process requiring special sharpening stones or other sharpening media, the sharpening procedure is often neglected by the consumer either because of the perceived time-consuming nature of sharpening the blade, or by the hesitancy in their ability to actually sharpen the blade. Thus the blade, once it is dull, may rarely be re-sharpened. Therefore, it may not be sharp when there is a significant need to cut something with the blade. In particular, this need could arise in the field when a hunter, hiker, worker, etc. is outdoors, away from sharpening equipment.

Various devices have been patented for sharpening knives. For example, U.S. Pat. No. 1,359,448, issued to Stodder, discloses a knife having removable handle members which allow access to a sharpening stone carried within an opening provided in the shank of the knife blade.

U.S. Pat. No. 407,055, issued to Brede; U.S. Pat. No. 848,251, issued to Killian; U.S. Pat. No. 916,630, issued to Timmons; U.S. Pat. No. 927,532, issued to Heissenberger; U.S. Pat. No. 1,299,173, issued to Grey; U.S. Pat. No. 1,627,689, issued to Culver; and U.S. Pat. No. 2,270,074, issued to Miller, and British patent No. 5,785, issued to Watkins, et al., each disclose folding knives having sharpening devices.

While the foregoing designs are known, there still exists a need for an easy-to-carry and use sharpening system which provides for both coarse and fine sharpening of a knife blade in the field.

SUMMARY OF THE INVENTION

It is, therefore, the principal object of the present invention to provide a sheath knife having sharpening member handles which may be easily detached and used for sharpening the edge of the knife's blade.

It is another object of the present invention to provide a sheath knife with sharpening member handles, wherein the sharpening member of one handle is of differing grit than the sharpening member of the other handle member.

It is another object of the present invention to provide a sheath knife with sharpening member handles which provide for gripping members for allowing the user to sharpen the edge of a blade while keeping his or her fingers away from the working interface between the sharpening stone and the knife edge.

A further object of the present invention is to provide a sheath knife of simple construction having handle members which form a comfortable grip and which include sharpening members.

It is a still further object of the present invention to provide a method for sharpening a blade using a knife with sharpening member handles.

Generally, the present invention includes a knife having an elongated blade member with an edge portion, a first end, and a second end opposite the first end. The first end of the blade member defines a tang, and the tang defines a first side and a second side opposite the first side.

First and second handle members are releaseably connected to the tang, the first handle member being connected to the first side of the tang, and the second handle member being connected to the second side of the tang. The first handle member has a first interior portion adjacent the first side of the tang, and the second handle member has a second interior portion adjacent the second side of the tang.

A first sharpening member is connected to the first interior portion of the first handle member and has a substantially planar sharpening surface of a first grit. A second sharpening member is connected to the second interior portion of the second handle member and has a substantially planar sharpening surface of a second grit, the second grit being of a different grit than the first grit.

Also provided are attachment means for releaseably connecting the first and second handle members to the tang, wherein the first and second handle members are removable for using the first and second sharpening members for sharpening the edge of the blade.

A method for sharpening the knife with the handle member sharpening members is also disclosed.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figures 1, 2:
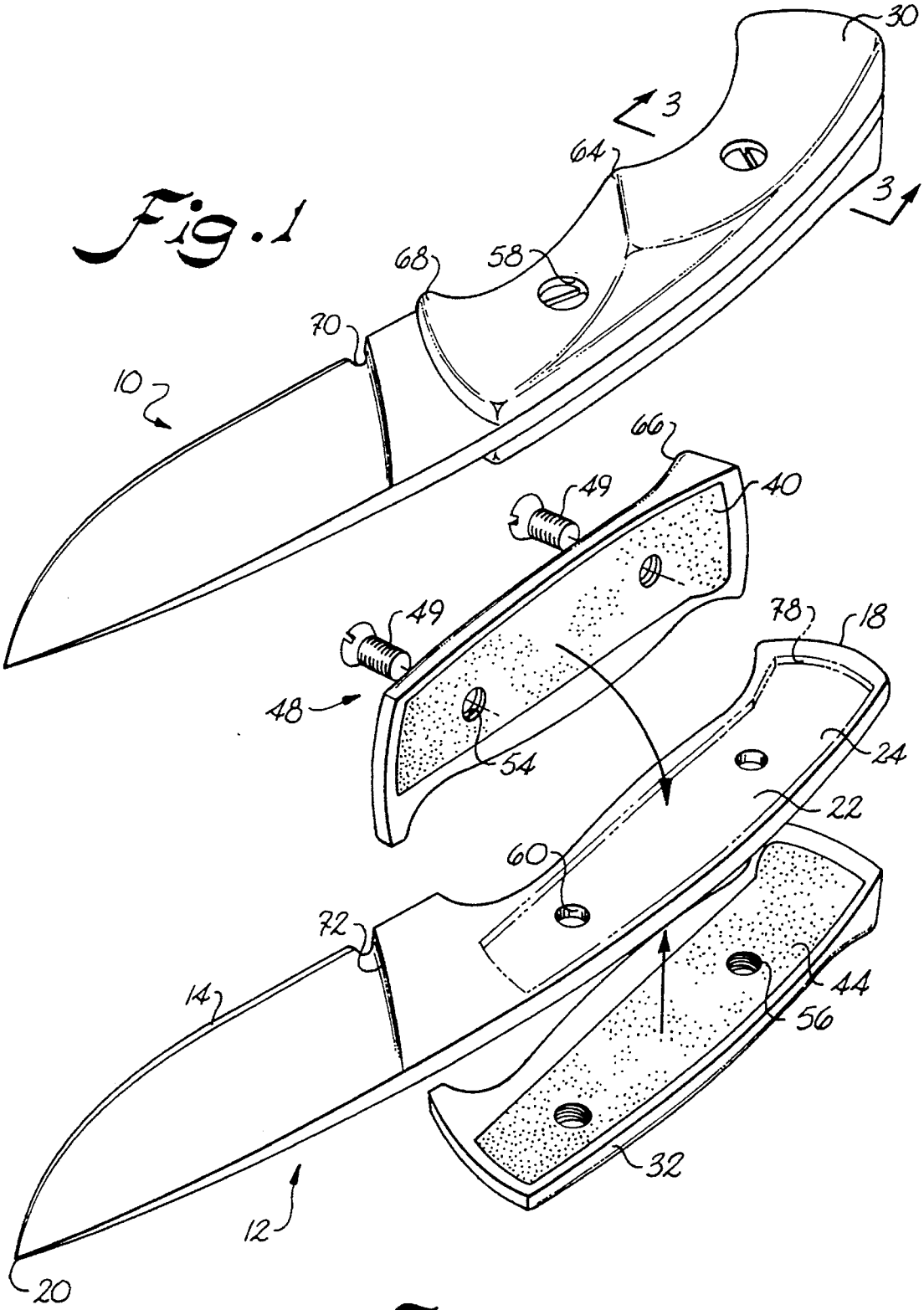
FIG. 1 is a perspective view of a knife with sharpening member handles constructed in accordance with the present invention.
FIG. 2 is an exploded view of a knife with sharpening member handles constructed in accordance with the present invention.

The accompanying drawings and the description which follows set forth this invention in its preferred embodiment. However, it is contemplated that persons generally familiar with knives will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the knife of the present invention is indicated generally in the figures by reference character 10.

Turning to FIG. 1 of the drawings, knife 10 is illustrated having an elongated blade member, generally 12, with a sharpened edge portion 14, and a first end 18, and a second end 20 opposite first end 18. The first end 18 of blade member 12 defines an elongated shank, or tang 22. Tang 22 has a first side 24, and a second side 26 opposite first side 24. Blade 12 is preferably constructed of cutlery steel, ceramic material, polymer material, or any other suitable material usable for a cutting instrument.

First and second handle members 30, 32 are illustrated in FIG. 1 as being securely connected to tang 22 of blade 12. Handle member 30 is connected to first side 24 of tang 22, and handle member 32 is connected to second side 26 of tang 22. Each handle member 30, 32 defines an interior portion, or compartment 34, 36, respectively, which faces the respective side 24, 26 of tang 22 when handle members 30, 32 are attached to tang 22.

Handle member 30 includes a sharpening member 38 carried in compartment 34. Sharpening member 38 includes a substantially planar sharpening surface 40 for sharpening edge 14 of blade 12. Likewise, handle member 32 includes a sharpening member 42 carried in compartment 36 thereof. Sharpening member 42 has a substantially planar sharpening surface 44 for engaging edge 14. Preferably, sharpening surfaces 40, 44 are of differing levels of abrasiveness, or texture, commonly known as grit. For instance, sharpening surface 40 could be of coarse grit on the order of 325, and it would be used first in the sharpening process to get edge 14 in a roughly sharpened state by dragging edge 14 across sharpening surface 14, or vice versa. Then, sharpening surface 44, which could be of a finer grit, for example, 600, would be used to finely hone edge 14 to a smooth, uniform, sharpened edge in like manner. Sharpening surface 38 could also be used to touch up a nearly sharp blade if a complete sharpening job is not desired. Although specific grits have been mentioned above, it is to be understood that any number of grits could be used to achieve satisfactory results. Also, if desired, sharpening surfaces 40 and 44 could be of substantially the same grit.

Sharpening members 38, 42 are preferably steel plates having a diamond coating provided thereon as sharpening surfaces 40, 44. However, it is to be understood that instead of the diamond coated plates, conventional sharpening stones could be used. Handle members 30, 32 are preferably molded from glass-filled nylon, although a variety of other materials could be used to construct handles 30, 32, such as bone, wood, metal, or other suitable polymer materials. Compartments 34, 36 are elongated and of a generally rectangular-like shape for receipt of sharpening members 38, 42, which are preferably a cooperating shape with compartments 34, 36 such that sharpening members 38, 42 snugly fit within respective compartments 34, 36. Sharpening members 38, 42 could be molded into the respective compartments 34, 36 or could be secured in the compartments by a press-fit or with adhesives. It is to be understood that sharpening members 38, 42 are not limited to the shapes disclosed herein, and could be of a variety of different shapes. The sharpening members, in one preferred embodiment, are seated within the respective compartments 34, 36 such that they extend slightly outwardly from the compartments between 0.005 and 0.008 of an inch to allow the sharpening members to pass freely over the edge of the knife blade 12 without contacting handle members 30, 32.

Handle members 30, 32 are attached to tang 22 through use of conventional attachment means, generally 48, which are illustrated in the drawings as screws 49. It is to be understood, however, that instead of screws 49, a variety of other releasable fasteners could be used, such as screw/wingnut combinations, spring-loaded fasteners, quick-release fasteners, and bolt and nut combinations. Also, although not shown, the handles 30, 32 could be held onto tang 22 and with respect to one another by a press fit arrangement wherein the handles could be pried off of tang 22 through use of a screwdriver, another knife blade, etc.

An important feature of the present invention is that sharpening members 38, 42 extend slightly outwardly from compartments 34, 36 of handle members 30, 32, as indicated by upstanding edges 50, 52 of sharpening members 38, 42, respectively. This allows for handle members 30, 32 to be used in sharpening edge 14 of blade 12 in a manner such that only sharpening surfaces 40, 44 actually contact edge 14, and there is no direct contact between edge 14 and handle members 30, 32. This serves to prevent damage to handle members 30, 32, and also facilitates sharpening of edge 14.

Figure 3:
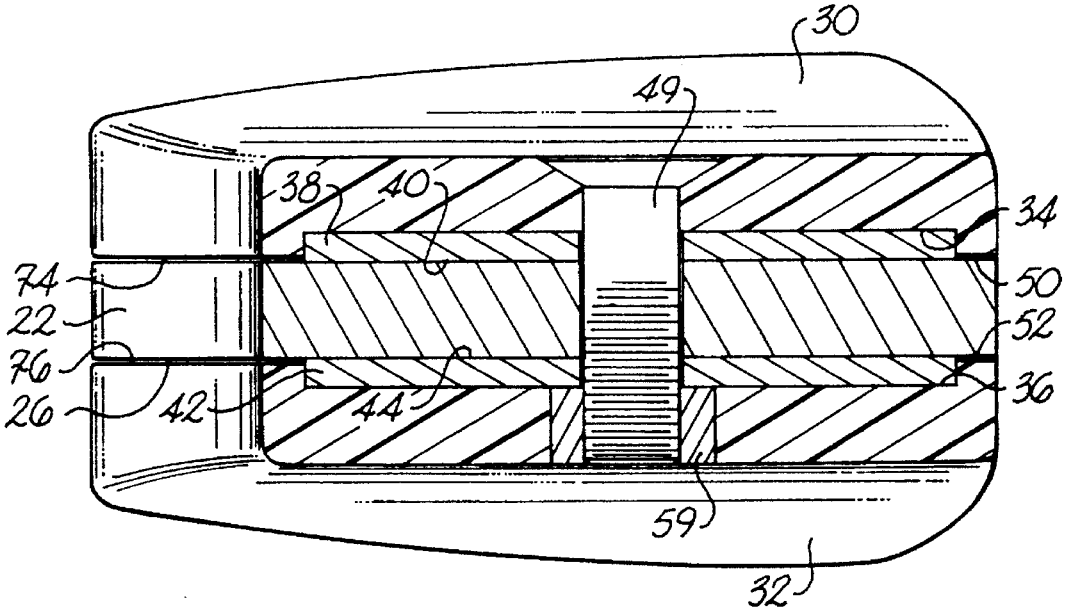
FIG. 3 is a sectional view taken along lines 3—3 of FIG. 1.
Figure 4:
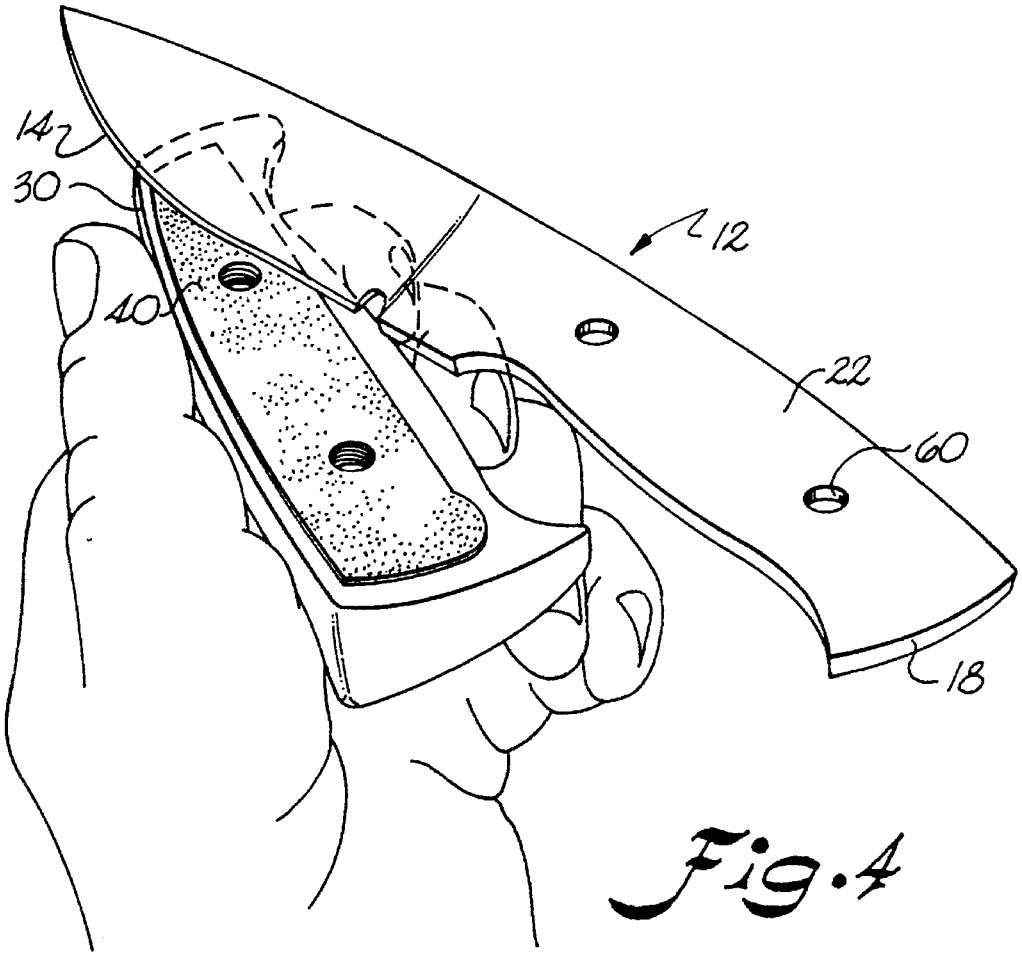
FIG. 4 is a perspective view of a knife with sharpening member handles constructed in accordance with the present invention, wherein a user is sharpening the edge of the knife blade with a sharpening member of a handle portion.

Turning to FIGS. 2, 3, and 4, attachment of handle members 30, 32 to blade 12 will be discussed in more detail. As illustrated in those figures, sharpening members 38, 42 include holes 54, 56, respectively, for receipt of screws 49. Handle member 30 includes countersunk holes 58 for receipt of the heads of screws 49. Tang 22 includes holes 60 for receipt of screws 49, and handle member 32 includes threaded bosses 59 for threadingly receiving screws 49, which act to hold handle members 30, 32 together on tang 22. It is noted that holes 54, 56, 58, and 60 could be smooth bore or threaded, as desired.

Referring to knife 10 as assembled with handle members 30, 32, handle members 30, 32 each include handgrip profiles 64, end knobs 66 adjacent blade end 18, and hand guard member portions 68 opposite end knobs 66. Blade member 12 includes a choil 70 adjacent blade edge 14, and a shoulder 72 adjacent choil 70.

The raised profile portions 64, 66, and 68 of handle members 30, 32 are particularly useful during sharpening of blade edge 14. This is because those raised portions allow the user's fingers to be removed from the sharpening surface-blade edge interface during sharpening of edge 14. This provides an additional measure of safety in preventing the user from cutting his or her fingers during sharpening of edge 14. It also provides for a more convenient and comfortable sharpening of edge 14.

The present construction provides for relatively economic manufacture of knife 10. No special machining is required for production of blade member 12 for receipt of the sharpening members 38, 42. A blade member 12 having smooth sides 22, 24 can be used. Additionally, sharpening members 38, 42 could, if desired, be replaced without requiring replacement of handle members 30, 32. Moreover, handle members 30, 32 are preferably molded of a somewhat compressible material, such as a plastic-type material. This allows attachment means 48 to be tightened sufficiently such that the sharpening members compress handle members 30, 32 slightly such that the sharpening members are depressed virtually entirely within compartments 34, 36. This allows sharpening surfaces 40, 44 to be substantially flush with peripheral surfaces 74, 76 of handle members 30, 32, thereby allowing a substantially flush fit of surfaces 74, 76 against tang 22, to produce a comfortable, substantially gap-less interface.

Alternatively, as shown in FIG. 2, instead of blade member 12 having a tang 22 with smooth sides 24, 26, cavities 78 could be provided in sides 24, 26 for receipt of sharpening members 38, 42, if desired, for also providing a flush fit between surfaces 74, 76 of handle members 30, 32 and sides 24, 26 of tang 22.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A knife, comprising:

an elongated blade member having an edge portion and a first end and a second end opposite said first end; said first end of said blade member defining a tang; said tang defining a first side and a second side opposite said first side;

first and second handle members connected to said tang; said first handle member being connected to said first side of said tang, and said second handle member being connected to said second side of said tang; said first handle member having a first compartment adjacent said first side of said tang;

a first sharpening member carried in said first compartment of said first handle member;

attachment means associated with said tang and said first handle member for releaseably connecting said first handle member to said tang, wherein said first handle member is removable for using said first sharpening member for sharpening said edge of said blade; and means for causing said first sharpening member to extend outwardly beyond said first handle member, when said first handle member is detached from said elongated blade, and for said first sharpening member to extend substantially flush with said first handle member when said first handle member is attached to said elongated blade with said attachment means.

2. A knife as defined in claim 1, wherein said first sharpening member is stone.

3. A knife as defined in claim 1, wherein said first sharpening member is diamond-coated metal member.

4. A knife as defined in claim 1, wherein said first sharpening member has a planar sharpening surface of a grit of 325.

5. A knife as defined in claim 1, wherein said attachment means is at least one screw.

6. A knife as defined in claim 1, wherein said first handle member, said tang, and said first sharpening member defines openings for receipt of said attachment means.

7. A knife as defined in claim 1, wherein said first handle member is constructed of compressible material.

8. A knife, comprising:

an elongated blade member having an edge portion and a first end and a second end opposite said first end; said first end of said blade member defining a tang; said tang defining a first side and a second side opposite said first side;

first and second compressible handle members releaseably connected to said tang; said first handle member being connected to said first side of said tang, and said second handle member being connected to said second side of said tang; said first handle member having a first compartment adjacent said first side of said tang, and said second handle member having a second compartment adjacent said second side of said tang;

a first sharpening member carried in said first compartment of said first handle member; said first sharpening member extending outwardly from said first handle member having a substantially planar sharpening surface of a first grit;

a second sharpening member carried in said second compartment of said second handle member; said second sharpening member extending outwardly from said first handle member having a substantially planar sharpening surface of a second grit, said second grit being of a different grit than said first grit;

attachment means for releaseably connecting said first and second handle members to said tang, wherein said first and second handle members are removable for using said first and second sharpening members for sharpening said edge of said blade; and means for causing said first and second sharpening members to extend outwardly beyond said first and second handles members, respectively, when said first and second handle members are detached from said elongated blade, and for said first and second sharpening members to extend substantially flush with said first and second handle members when said first and second handle members are attached to said elongated blade with said attachment means.

9. A knife as defined in claim 8, wherein said first and second sides of said tang each define a cavity for receiving said first and second sharpening members, respectively, when said first and second handle members are attached to said tang by said attachment means.

10. A method of sharpening the blade of a sheath knife, comprising:

providing a sheath knife having a blade with an edge portion and a tang portion;

providing first and second handle members connected to said tang portion with at least one fastener, each of said first and second handle members having a sharpening member of differing grit from the other said sharpening member;

removing said first and second handle members from said tang portion by removing said at least one fastener;

sharpening said edge portion of said blade with said first sharpening member of said first handle member;

sharpening said edge portion of said blade with said second sharpening member of said second handle member; and reattaching said first and second handle members onto said tang with said at least one fastener such that said sharpening members of said first and second handle members extend substantially flush with said first and second handle members when said first and second handle members are reattached to said elongated blade.

11. A sheath knife, comprising:

an elongated blade member having an edge portion and a first end and a second end opposite said first end; said first end of said blade member defining a tang; said tang defining a first side and a second side opposite said first side;

first and second handle members releaseably connected to said tang; said first handle member being connected to said first side of said tang, and said second handle member being connected to said second side of said tang; said first handle member having a first compartment adjacent said first side of said tang, and said second handle member having a second compartment adjacent said second side of said tang;

a first sharpening member carried in said first compartment of said first handle member; said first sharpening member having a first planar sharpening surface of a first grit;

a second sharpening member carried in said second compartment of said second handle member; said second sharpening member having a second planar sharpening surface of a second grit, said second grit being of a different grit than said first grit;

attachment means associated with said tang and said first and second handle members for releaseably connecting said first and second handle members to said tang, wherein said first and second handle members are removable for using said first and second sharpening members for sharpening said edge of said blade; and means for causing said first and second sharpening members to extend outwardly beyond said first handle member, when said first handle member is detached from said elongated blade, and for said first sharpening member to extend substantially flush with said first handle member when said first handle member is attached to said elongated blade with said attachment means.

* * * * *